US007641199B1

(12) United States Patent
Clarke

(10) Patent No.: US 7,641,199 B1
(45) Date of Patent: Jan. 5, 2010

(54) PENDULUM BASKETBALL GAME

(76) Inventor: William A Clarke, 4549 Budd Dr., Erie, PA (US) 16506

( * ) Notice: Subject to any disclaimer, the term of this patent is extended or adjusted under 35 U.S.C. 154(b) by 0 days.

(21) Appl. No.: 12/316,029

(22) Filed: Dec. 9, 2008

(51) Int. Cl.
*A63F 9/00* (2006.01)

(52) U.S. Cl. ..... 273/330; 317/317.3; 317/329; 317/331

(58) Field of Classification Search ..... 273/317, 273/317.3, 329–331
See application file for complete search history.

(56) References Cited

U.S. PATENT DOCUMENTS

| | | | | | |
|---|---|---|---|---|---|
| 2,089,652 | A | | 8/1937 | Kelly | |
| 2,105,462 | A | * | 1/1938 | Brinkman | 273/329 |
| 2,246,041 | A | * | 6/1941 | Halberstadter | 446/247 |
| 2,399,636 | A | * | 5/1946 | Johnson | 446/421 |
| 2,414,063 | A | * | 1/1947 | Rogers | 446/247 |
| 3,092,387 | A | * | 6/1963 | Wagner | 273/317.3 |
| 3,610,622 | A | | 10/1971 | Haroski | |
| 3,936,051 | A | | 2/1976 | Walker, Jr. | |
| 4,000,898 | A | | 1/1977 | Cooter | |
| 4,040,623 | A | * | 8/1977 | Ott | 273/329 |
| 4,248,435 | A | | 2/1981 | Barmore | |
| 4,300,771 | A | * | 11/1981 | Lori | 273/329 |
| 5,249,810 | A | * | 10/1993 | Cazalet | 273/330 |
| 5,286,031 | A | | 2/1994 | Walker, Jr. | |
| 5,288,083 | A | * | 2/1994 | Palmieri | 273/329 |
| 5,348,307 | A | * | 9/1994 | Duggan | 473/507 |
| 5,405,149 | A | * | 4/1995 | Allen | 273/330 |
| 5,722,662 | A | * | 3/1998 | Howell | 273/329 |
| 5,829,751 | A | * | 11/1998 | Willis | 273/330 |

* cited by examiner

*Primary Examiner*—Raleigh W. Chiu
(74) *Attorney, Agent, or Firm*—Richard K Thomson

(57) ABSTRACT

A basketball-like member is mounted on one end of a pendulum adapted to swing in an arc about a cylindrical bearing attached to a support extending from a discontinuity of a first side of a partially cylindrical hoop through which the basketball member is repetitively swung to score points. A handle on a second opposite side is grasped and the tethered ball manipulated to cause the repetitive arcuate travel through the hoop. A battery-powered counter keeps track of the number of baskets or points scored, at the preference of the player.

14 Claims, 1 Drawing Sheet

PENDULUM BASKETBALL GAME

BACKGROUND AND SUMMARY OF THE INVENTION

The present invention is directed to the field of toys. More particularly, the present invention is directed to a basketball-like member attached to a pendulum which can be repetitively swung through a partially cylindrical hoop to simulate scoring baskets.

A number of simulated basketball games are currently known. Most such games have simulated players that attempt shots at the hand of the real player. Similarly, the prior art includes a number of tethered ball devices which can be swung to engage a target of one variety or another. Yet, in each of these devices, something is missing. Something is lacking that gives the device a "gotta have it" quality, a nature that gets the competitive juices flowing of any kid (regardless of age) the moment s/he lays eyes on it. The pendulum basketball game of the present invention has, at the core of its nature, that quality and, once kids get started competing on the device, it is hard to get them to stop!

The pendulum basketball game of the present invention comprises a competitive game device including a) a partially cylindrical hoop with a discontinuity on a first side, the partially cylindrical hoop having a handle on a second side opposite to the discontinuity and a support extending from the discontinuity; b) a basketball-like member attached to a first end of a tether; c) a cylindrical bearing attached to a second end of the tether, the cylindrical bearing being mounted for rotation on the support; whereby the basketball-like member can be repeatedly swung in a continuous arc to travel through the cylindrical hoop to make successive baskets. Preferably, the support comprises a U-shaped extension protruding from a first side of the discontinuity to a second side of the discontinuity. The cylindrical bearing is mounted to rotate on a base portion of the U-shaped extension.

The competitive game device may include a simulated net extending from a bottom portion of the partially cylindrical hoop. Preferably, the tether comprises a flexible, inelastic cord. A projection extends into the partially cylindrical hoop from the handle side which is adapted to be struck by the basketball-like member once on each continuous arc. The projection is attached to a counter mounted on the handle to keep track of a number of times the basketball-like member contacts the projection during a course of a turn. Preferably, the counter includes button controls to switch the counter between counting a number of baskets made to counting a number of points scored.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
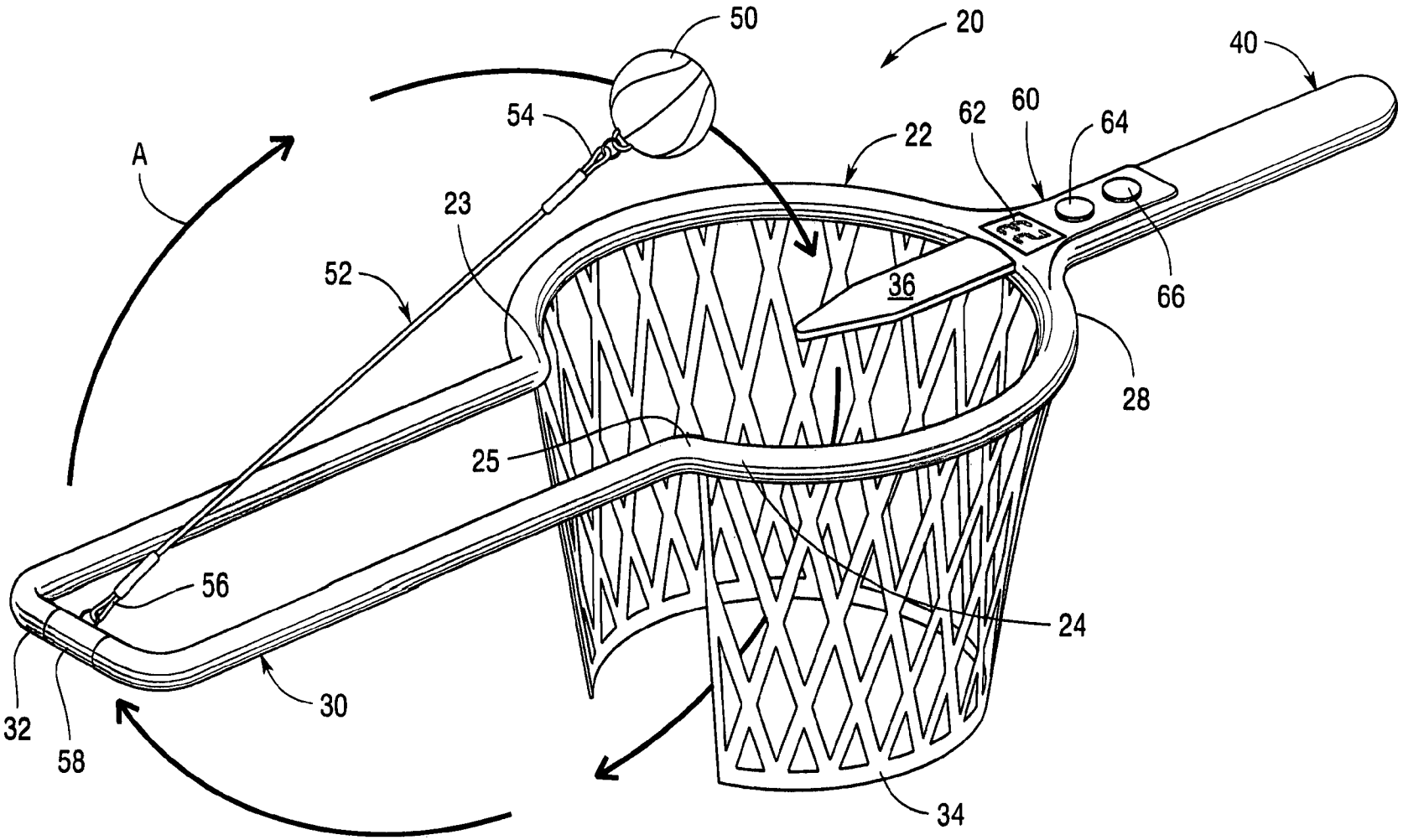
FIG. 1 is a perspective front view of a first embodiment of the pendulum basketball game of the present invention.

A first preferred embodiment of the pendulum basketball game of the present invention is depicted in FIG. 1 at 20. The competitive game device 20 of the present invention includes a partially cylindrical hoop 22 with a discontinuity on a first side 24. A U-shaped support 30 extends from a first side 23 of the discontinuity to a second side 25 thereof. A handle 40 extends from a second side 28 of hoop 22, second side 28 being on an opposite side to first side 23. A basketball-like member 50 is attached to a first end 54 of a tether 52. Tether 52 is preferably a flexible, inelastic cord which has good strength and durability. Cylindrical bearing 58 is attached to a second end 56 of tether 52, cylindrical bearing 58 being mounted for rotation on a base portion 32 of U-shaped support 30. A simulated net 34 can extend downwardly below hoop 22, net 34 being made of a rigid, durable plastic.

A projecting finger 36 extends into hoop 22 where it is adapted to be struck by basketball-like member 50 once each time it travels along arc A as it is swung through hoop 22. Projecting finger 36 is connected to counter 60 mounted on handle 40. Counter screen 62 reflects each time basketball-like member 50 contacts finger 36 and increases the total shown. It is envisioned that the counter 60 will be powered by a Ni-Cad battery inserted through a door (not shown) on the bottom side of handle 40. Button 64 can turn counter 60 on and reset the total to zero, while pushbutton 66 can switch the counter from counting number of baskets to number of points, adding two points for each contact with projecting finger 36.

The competitive game device 20 of the present invention can be grasped by handle 40 and an arcuate swing of basketball-like member 50 initiated along arc A. Once the swing is begun, a rhythmic up-and-down motion can sustain a repetitive scoring as basketball-like member 50 repeatedly engages finger 36. However, should the player lose that rhythm, the basketball-like member 50 will deviate from its path and the player's turn will be over. Her/his opponent(s) can, then, sequentially attempt to best her/his record by sustaining the proper movement for a greater length of time. In field trials, kids from a wide age group have shown a fascination with engaging in the competitive opportunity this pendulum basketball game 20 affords.

Various changes, alternatives, and modifications will become apparent to a person of ordinary skill in the art after a reading of the foregoing specification. For example, although the game device has been embodied as a basketball game, it will be appreciated that the ball-like member could be a soccer ball, a hockey puck, a football, and any other similar item. Then, the scoring by the counter could be adjusted to accommodate the points associated with the respective sport. It is intended that all such changes, alternatives, and modifications as fall within the scope of the appended claims be considered part of the present invention.

I claim:

1. A competitive game device comprising a) a partially enclosing hoop with a discontinuity on a first side, said partially enclosing hoop having a handle on a second side opposite to said discontinuity and a support extending from said discontinuity;

b) a ball-like member attached to a first end of a tether;

c) a cylindrical bearing attached to a second end of said tether, said cylindrical bearing being mounted for rotation on said support;

d) a simulated net extending from a bottom portion of said partially enclosing hoop;

whereby said ball-like member can be repeatedly swung in a continuous arc to travel through said partially enclosing hoop to make successive baskets.

2. The competitive game device of claim 1 wherein said support comprises a U-shaped extension protruding from a first side of said discontinuity to a second side of said discontinuity.

3. The competitive game device of claim 2 wherein said cylindrical bearing is mounted to rotate on a base portion of said U-shaped extension.

4. The competitive game device of claim 1 wherein said tether comprises a flexible, inelastic cord.

5. The competitive game device of claim 1 further comprising a projecting finger extending into said partially enclosing hoop from said handle side which is adapted to be struck by said ball-like member once on each continuous arc.

6. The competitive game device of claim 5 wherein said projecting finger is attached to a counter mounted on said handle to keep track of a number of times said ball-like member contacts said projection during a course of a turn.

7. The competitive game device of claim 6 wherein said counter is electronic and includes a compartment which houses battery means to power said counter.

8. The competitive game device of claim 7 wherein said counter includes button controls to switch said counter between counting a number of passes through said partially enclosing hoop to counting a number of points scored.

9. A competitive game device comprising a) a partially enclosing hoop with a discontinuity on a first side, said partially enclosing hoop having a handle on a second side opposite to said discontinuity and a support extending from said discontinuity;

b) a ball-like member attached to a first end of a tether;

c) a cylindrical bearing attached to a second end of said tether, said cylindrical bearing being mounted for rotation on said support;

d) counter means for recording a score associated with a number of passes through said partially enclosed loop;

e) controls permitting a player to switch between counting said number of passes through said partially enclosed loop to counting a number of points scored;

whereby said ball-like member can be repeatedly swung in a continuous arc to travel through said partially enclosing hoop.

10. The competitive game device of claim 9 further comprising a simulated net extending from a bottom portion of said partially enclosing hoop.

11. The competitive game device of claim 9 wherein said support comprises a U-shaped extension protruding from a first side of said discontinuity to a second side of said discontinuity.

12. The competitive game device of claim 11 wherein said cylindrical bearing is mounted to rotate on a base portion of said U-shaped extension.

13. The competitive game device of claim 9 wherein said tether comprises a flexible, inelastic cord.

14. The competitive game device of claim 9 further comprising a projecting finger extending into said partially enclosing hoop from said handle side which is adapted to be struck by said ball-like member once on each continuous arc, said projecting finger being attached to said counter means.

* * * * *